US010262574B2

(12) United States Patent
Li et al.

(10) Patent No.: US 10,262,574 B2
(45) Date of Patent: Apr. 16, 2019

(54) DRIVER SIGNAL CONTROL CIRCUIT FOR DISPLAY PANEL AND DISPLAY PANEL

(71) Applicant: Shenzhen China Star Optoelectronics Technology Co., Ltd., Shenzhen, Guangdong (CN)

(72) Inventors: Wenfang Li, Guangdong (CN); Dan Cao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 299 days.

(21) Appl. No.: 15/300,777

(22) PCT Filed: Aug. 4, 2016

(86) PCT No.: PCT/CN2016/093236
§ 371 (c)(1),
(2) Date: Sep. 29, 2016

(87) PCT Pub. No.: WO2017/206315
PCT Pub. Date: Dec. 7, 2017

(65) Prior Publication Data

US 2018/0182280 A1 Jun. 28, 2018

(30) Foreign Application Priority Data

May 30, 2016 (CN) ..... 2016 1 0371057

(51) Int. Cl.
*G09G 3/36* (2006.01)
*G09G 3/20* (2006.01)
*G09G 3/3266* (2016.01)

(52) U.S. Cl.
CPC ..... *G09G 3/2092* (2013.01); *G09G 3/3266* (2013.01); *G09G 3/3677* (2013.01); *G09G 2310/0251* (2013.01); *G09G 2310/08* (2013.01)

(58) Field of Classification Search
CPC ... G09G 3/36; G09G 5/00; G09G 3/10; G06F 3/038
See application file for complete search history.

(56) References Cited

U.S. PATENT DOCUMENTS

2008/0225035 A1 9/2008 Hsu
2010/0123708 A1* 5/2010 Jang ..... G09G 3/3648 345/213

(Continued)

FOREIGN PATENT DOCUMENTS

CN 101826315 A 9/2010
CN 101937640 A 1/2011

(Continued)

*Primary Examiner* — Pegeman Karimi
(74) *Attorney, Agent, or Firm* — Andrew C. Cheng

(57) ABSTRACT

A driver signal control circuit for a display panel is proposed. A timing controller is connected to an input terminal of a gate voltage shaping controller and a first FET. A first output terminal of the gate voltage shaping controller is connected to a gate of the first FET. A drain of the first FET is connected to the output terminal of the control circuit. A second output terminal of the gate voltage shaping controller is connected to a gate of the second FET, and a source of the second FET is connected to the output terminal of the control circuit. A second terminal of the discharge passage is connected to an output terminal of the control circuit. The control circuit effectively prevents the production costs when display panels with different production batches are fabricated using different fabrication processes.

14 Claims, 1 Drawing Sheet

(56) References Cited

U.S. PATENT DOCUMENTS

| | | | | |
|---|---|---|---|---|
| 2010/0309190 | A1* | 12/2010 | Hasegawa | G09G 3/3696 345/212 |
| 2011/0193839 | A1* | 8/2011 | Smith | G09G 3/3677 345/208 |
| 2013/0069925 | A1* | 3/2013 | Lin | G09G 5/00 345/211 |

FOREIGN PATENT DOCUMENTS

| | | | |
|---|---|---|---|
| CN | 102280094 | A | 12/2011 |
| CN | 102881272 | A | 1/2013 |

* cited by examiner

DRIVER SIGNAL CONTROL CIRCUIT FOR DISPLAY PANEL AND DISPLAY PANEL

BACKGROUND

1. Field of the Disclosure

The present disclosure relates to the field of signal processing technology, and more particularly, to a driver signal control circuit for a display panel and a display panel with the driver signal control circuit.

2. Description of the Related Art

One-side driving and both-side driving methods are adopted by a conventional display panel. With respect to the one-side driving method, a display driver signal is transmitted to one side of the display panel (such as the left side of the display panel) for most of time. Because of the RC delay in the display panel, the display effect on the left side of the display panel is different from the display effect on the right side.

To enhance the display effect of the display panel adopting the one-side driving method, a display driver signal supplied to the display panel undergoes the chamfer process in the conventional technology. Accordingly, the problem that a shot mura appears on the panel due to the RC delay is solved FIG. 1 is a circuit diagram illustrating a conventional display driver signal undergoing the chamfer process. Refer to FIG. 1 illustrating the conventional display driver signal undergoing the chamfer process.

As FIG. 1 shows, VGH represents a display driver signal transmitted by a display driver signal transmit unit, and VGHM represents a display driver signal supplied to the display panel. A timing controller generates a control signal. The control signal controls conduction and termination of a first field-effect transistor (FET) Q1 and a second FET Q2 after passing a gate voltage shaping controller. When the first FET Q1 is conducted and the second FET Q2 is turned off, the VGHM is pulled up to be at the VGH voltage level. When the first FET Q1 is turned off and the second FET Q2 is conducted, the VGHM discharges through a resistor R1. In other words, the voltage imposed on the VGHM is pulled down so that the VGHM can undergo the chamfer process.

As for the method of processing the display driver signal with chamfering, the chamfering speed and the chamfering depth of the VGHM are adjusted by adjusting the resistance of the resistor R1. Because of the RC difference for the display panel, the display panels need a proper chamfering speed and a proper chamfering depth during the process of fabricating the display panels in batches. With the proper chamfering speed and the proper chamfering depth, the display effect of the display panel reaches optimal. The resistance of the resistor R1 needs to be adjusted for the display panels in production batches. In other words, the resistance of the resistor R1 is constantly changing during the process of fabricating the display panels in batches, which resulting in the production costs of the display panel on the increase.

SUMMARY

A driver signal control circuit for a display panel is proposed by a preferred embodiment of the present disclosure. The present disclosure aims to solve problems about one-side driving in the conventional technology. The problems are that it is not convenient to adjust the resistance to improve the display effect of the display panel and the production costs are higher.

According to the present disclosure, a driver signal control circuit for a display panel includes a timing controller, a gate voltage shaping controller, a first field-effect transistor (FET), a second FET, a first resistor, and a discharge passage. A first terminal of the timing controller is connected to an input terminal of the gate voltage shaping controller. A first output terminal of the gate voltage shaping controller is connected to a gate of the first FET. A source of the first FET is connected to an input terminal of the control circuit. A drain of the first FET is connected to the output terminal of the control circuit. A second output terminal of the gate voltage shaping controller is connected to a gate of the second FET, a source of the second FET is connected to the output terminal of the control circuit, a drain of the second FET is connected to a first terminal of the first resistor. A second terminal of the first resistor is grounded. A second terminal of the timing controller is connected to a first terminal of the discharge passage. A second terminal of the discharge passage is connected to an output terminal of the control circuit.

Optionally, the timing controller generates a first control signal and transmit the first control signal to the gate voltage shaping controller. When the first control signal is at a first effective voltage level, the first FET is conducted, the second FET is turned off, and voltage imposed on the output terminal of the control circuit is pulled up to voltage imposed on the input terminal of the control circuit. When the first control signal is at a second effective voltage level, the first FET is turned off, the second FET is conducted, and the output terminal of the control circuit discharges through the first resistor to pull down the voltage imposed on the output terminal of the control circuit.

Optionally, the timing controller further generates a second control signal. The generated second control signal is transmitted by the timing controller to a second discharge passage. The second discharge passage discharges from the output terminal of the control circuit according to the second control signal.

Optionally, the second discharge passage comprises a third FET and a second resistor. A second terminal of the timing controller is connected to a gate of the third FET, a drain of the third FET is grounded, a source of the third FET is connected to a first terminal of the second resistor, and a second terminal of the second resistor is connected to the output terminal of the control circuit.

Optionally, the second control signal is transmitted to the gate of the third FET. In response to the first effective voltage level of the second control signal, the third FET is conducted so that the output terminal of the control circuit discharges through the second resistor. In response to the second effective voltage level of the second control signal, the third FET is turned off so that the output terminal of the control circuit does not discharge.

Optionally, the duration of the first effective voltage level of the first control signal, the duration of the second effective voltage level of the first control signal, the duration of the first effective voltage level of the second control signal, and the duration of the second effective voltage level of the second control signal are ensured according to the real display effect of the display panel.

Optionally, the first FET and second FET are P-channel metal-oxide-semiconductor field effect transistors, and the third FET is an N-channel metal-oxide-semiconductor field effect transistor.

The application of the driver signal control circuit for a display panel makes it come true that a display driver signal undergoes the chamfer process, the display effect of the display panel is enhanced, and the production costs of the display panel are effectively reduced.

These and other features, aspects and advantages of the present disclosure will become understood with reference to the following description, appended claims and accompanying figures.

DETAILED DESCRIPTION OF THE PREFERRED EMBODIMENTS

For better understanding embodiments of the present disclosure, the following detailed description taken in conjunction with the accompanying drawings is provided. Apparently, the accompanying drawings are merely for some of the embodiments of the present invention. Any ordinarily skilled person in the technical field of the present invention could still obtain other accompanying drawings without use laborious invention based on the present accompanying drawings.

Figure 1:
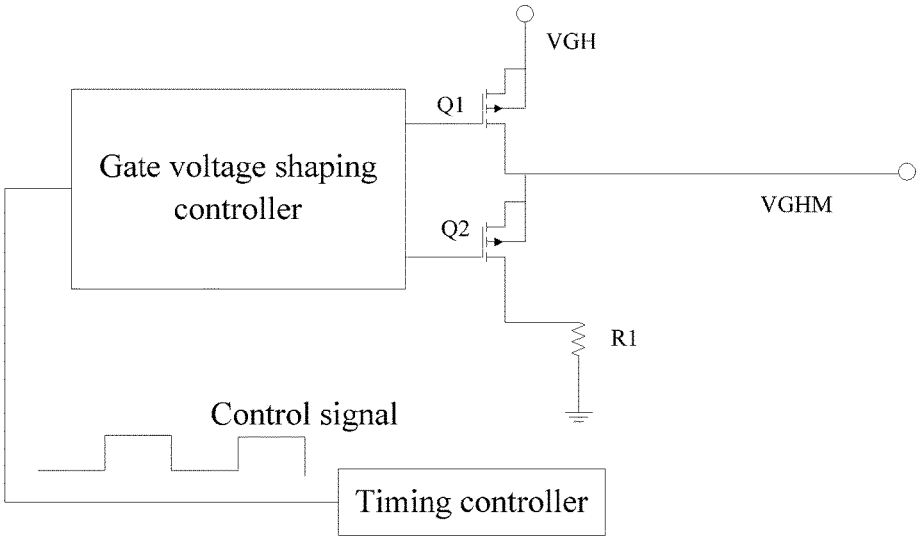
Fig. 1 (Related art)
FIG. 1 is a circuit diagram illustrating a conventional display driver signal undergoing the chamfer process.
Figure 2:
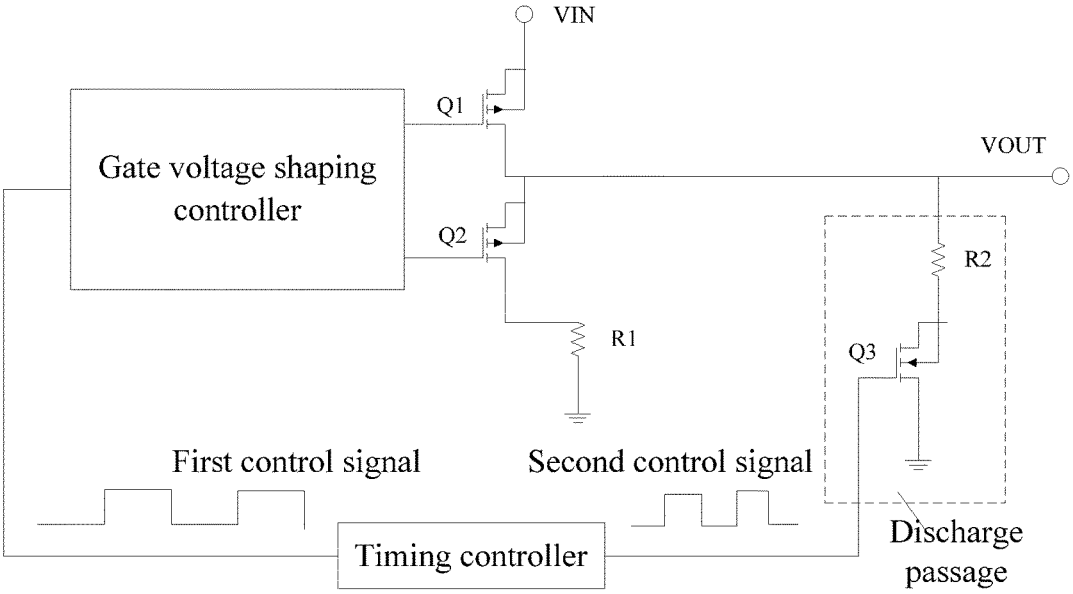
FIG. 2 is a circuit diagram illustrating a driver signal control circuit for a display panel according to a preferred embodiment of the present disclosure.

FIG. 2 is a circuit diagram illustrating a driver signal control circuit for a display panel according to a preferred embodiment of the present disclosure.

The driver signal control circuit comprises a timing controller, a gate voltage shaping controller, a first field-effect transistor (FET) Q1, a second FET Q2, a first resistor R1, and a discharge passage.

For example, the input terminal VIN of the control circuit receives the display driver signal from a display driver signal transmit unit. The display driver signal transmit unit may be a driver controller, such as a driver IC, in the display panel. The processed display driver signal is transmitted to each subpixel in the display panel from an output terminal VOUT of the control circuit. In other words, the display driver signal generated by the driver integrated circuit (IC) is processed by the control circuit proposed by the embodiment of the present disclosure and transmitted to each subpixel in the display panel to drive the display panel to show images.

A first terminal of the timing controller is connected to an input terminal of the gate voltage shaping controller. A first output terminal of the gate voltage shaping controller is connected to a gate of the first FET Q1. A source of the first FET Q1 is connected to the input terminal VIN of the control circuit. A drain of the first FET Q1 is connected to the output terminal VOUT of the control circuit. A second output terminal of the gate voltage shaping controller is connected to a gate of the second FET Q2. A source of the second FET Q2 is connected to the output terminal VOUT of the control circuit. A drain of the second FET Q2 is connected to a first terminal of the first resistor R1. A second terminal of the first resistor R1 is grounded. A second terminal of the timing controller is connected to a first terminal of the discharge passage. A second terminal of the discharge passage is connected to an output terminal VOUT of the control circuit.

The working principle of the driver signal control circuit for a display panel proposed by the present disclosure is detailed as follows.

Specifically, the driver signal control circuit for a display panel comprises a first discharge passage and a second discharge passage. The first discharge passage comprises the second FET Q2 and the first resistor R1. The timing controller can generate a first control signal and transmit the first control signal to the gate voltage shaping controller to control conduction and cutoff of the first discharge passage.

For example, when the first control signal is a first effective voltage level (such as a high voltage level), the first FET Q1 is conducted and the voltage imposed on the output terminal VOUT of the control circuit is pulled up to be the voltage imposed on the input terminal VIN of the control circuit. In other words, the voltage on the output terminal VOUT is approximately equal to the voltage on the input terminal VIN. At this time, the second FET Q2 is turned off, and the output terminal VOUT of the control circuit does not discharge through the first resistor R1.

When the first control signal is a second effective voltage level (such as a low voltage level), the first FET Q1 is turned off. At this time, the second FET Q2 is conducted. The output terminal VOUT of the control circuit discharges through the first resistor R1 to pull down the voltage imposed on the output terminal VOUT of the control circuit. For example, the first control signal may be a square wave signal. Preferably, the duration of the first effective voltage level of the square wave signal and the duration of the second effective voltage level of the square wave signal are adjusted according to the real display effect of the display panel. Accordingly, the chamfering speed and the chamfering depth of the voltage imposed on the output terminal VOUT of the control circuit are controlled during the process of pulling down the voltage.

In this embodiment, the first FET Q1 can be a P-channel metal-oxide-semiconductor field effect transistor. The second FET Q2 can be a PMOS transistor as well. The first FET Q1 and the second FET Q2 are conducted at different time (i.e., time-sharing conduction).

Preferably, the discharge passage shown in FIG. 2 is a second discharge passage used in the driver signal control circuit for a display panel proposed by the embodiment of the present disclosure. The timing controller further generates a second control signal. The second control signal is transmitted by the timing controller to the second discharge passage. The second control signal controls conduction and blockage of the second discharge passage to further discharge from the output terminal VOUT of the control circuit through the second discharge passage.

The second discharge passage further includes a third FET Q3 and a second resistor R2. The third FET Q3 may be an N-channel metal-oxide-semiconductor field effect transistor. A second terminal of the timing controller is connected to a gate of the third FET Q3. A drain of the third FET Q3 is grounded. A source of the third FET Q3 is connected to a first terminal of the second resistor R2. A second terminal of the second resistor R2 is connected to the output terminal VOUT of the control circuit.

Under this condition, the second control signal is transmitted to the gate of the third FET Q3. When the second control signal is the first effective voltage level (such as a high voltage level), the third FET Q3 is conducted. The output terminal VOUT of the control circuit discharges through the second resistor R2 to pull down the voltage imposed on the output terminal VOUT of the control circuit. When the second control signal is the second effective voltage level (such as a low voltage level), the third FET Q3 is turned off. At this time, the output terminal VOUT of the control circuit does not discharge.

Preferably, the duration of the first effective voltage level of the second control signal and the duration of the second effective voltage level of the second control signal are ensured according to the real display effect of the display panel. Accordingly, the chamfering speed and the chamfering depth of the voltage imposed on the output terminal VOUT of the control circuit are controlled during the process of pulling down the voltage.

The driver signal control circuit for a display panel proposed by the embodiment of the present disclosure comprises two discharge passages. Conduction or blockage of the two discharge passages are controlled by the duration of the first effective voltage level of the first control signal, the duration of the second effective voltage level of the first control signal, the duration of the first effective voltage level of the second control signal, and the duration of the second effective voltage level of the second control signal after the first control signal and the second control signal pass the timing controller. Accordingly, the chamfering speed and the chamfering depth of the voltage imposed on the output terminal VOUT of the control circuit are controlled during the process of pulling down the voltage. In this way, the display panel has a better display effect practically.

The above-mentioned electronic components used for the driver signal control circuit in the display panel are all fixed. The resistance of each of the resistors in the driver signal control circuit is a constant value. That the display driver signal undergoes the chamfer process is realizable by only adjusting the timing of the control signal output by the timer controller. The control circuit can be applied to all kinds of display panels, which effectively prevents the production costs from upsoaring when display panels with different production batches are fabricated using different fabrication processes.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A driver signal control circuit for a display panel, comprising: a timing controller, a gate voltage shaping controller, a first field-effect transistor (FET), a second FET, a first resistor, and a discharge passage;

wherein a first terminal of the timing controller is connected to an input terminal of the gate voltage shaping controller; a first output terminal of the gate voltage shaping controller is connected to a gate of the first FET; a source of the first FET is connected to an input terminal of the control circuit; a drain of the first FET is connected to the output terminal of the control circuit;

a second output terminal of the gate voltage shaping controller being connected to a gate of the second FET, a source of the second FET being connected to the output terminal of the control circuit, a drain of the second FET being connected to a first terminal of the first resistor; a second terminal of the first resistor being grounded;

a second terminal of the timing controller being connected to a first terminal of the discharge passage; a second terminal of the discharge passage being connected to an output terminal of the control circuit.

2. The control circuit of claim 1, wherein the timing controller generates a first control signal and transmit the first control signal to the gate voltage shaping controller;

when the first control signal is at a first effective voltage level, the first FET is conducted, the second FET is turned off, and voltage imposed on the output terminal of the control circuit is pulled up to voltage imposed on the input terminal of the control circuit;

when the first control signal is at a second effective voltage level, the first FET is turned off, the second FET is conducted, and the output terminal of the control circuit discharges through the first resistor to pull down the voltage imposed on the output terminal of the control circuit.

3. The control circuit of claim 1, wherein the timing controller further generates a second control signal; the generated second control signal is transmitted by the timing controller to a second discharge passage; the second discharge passage discharges from the output terminal of the control circuit according to the second control signal.

4. The control circuit of claim 3, wherein the second discharge passage comprises a third FET and a second resistor, and wherein a second terminal of the timing controller is connected to a gate of the third FET, a drain of the third FET is grounded, a source of the third FET is connected to a first terminal of the second resistor, and a second terminal of the second resistor is connected to the output terminal of the control circuit.

5. The control circuit of claim 4, wherein the second control signal is transmitted to the gate of the third FET, and wherein in response to the first effective voltage level of the second control signal, the third FET is conducted so that the output terminal of the control circuit discharges through the second resistor, and in response to the second effective voltage level of the second control signal, the third FET is turned off so that the output terminal of the control circuit does not discharge.

6. The control circuit of claim 1, wherein the duration of the first effective voltage level of the first control signal, the duration of the second effective voltage level of the first control signal, the duration of the first effective voltage level of the second control signal, and the duration of the second effective voltage level of the second control signal are ensured according to the real display effect of the display panel.

7. The control circuit of claim 1, wherein the first FET and second FET are P-channel metal-oxide-semiconductor field effect transistors, and the third FET is an N-channel metal-oxide-semiconductor field effect transistor.

8. A display panel comprising a driver signal control circuit, the driver signal control circuit comprising: a timing controller, a gate voltage shaping controller, a first field-effect transistor (FET), a second FET, a first resistor, and a discharge passage;

wherein a first terminal of the timing controller is connected to an input terminal of the gate voltage shaping controller; a first output terminal of the gate voltage shaping controller is connected to a gate of the first FET; a source of the first FET is connected to an input terminal of the control circuit; a drain of the first FET is connected to the output terminal of the control circuit;

a second output terminal of the gate voltage shaping controller being connected to a gate of the second FET, a source of the second FET being connected to the output terminal of the control circuit, a drain of the second FET being connected to a first terminal of the first resistor; a second terminal of the first resistor being grounded;

a second terminal of the timing controller being connected to a first terminal of the discharge passage; a second terminal of the discharge passage being connected to an output terminal of the control circuit.

9. The display panel of claim 8, wherein the timing controller generates a first control signal and transmit the first control signal to the gate voltage shaping controller;

when the first control signal is at a first effective voltage level, the first FET is conducted, the second FET is turned off, and voltage imposed on the output terminal of the control circuit is pulled up to voltage imposed on the input terminal of the control circuit;

when the first control signal is at a second effective voltage level, the first FET is turned off, the second FET is conducted, and the output terminal of the control circuit discharges through the first resistor to pull down the voltage imposed on the output terminal of the control circuit.

10. The display panel of claim 8, wherein the timing controller further generates a second control signal; the generated second control signal is transmitted by the timing controller to a second discharge passage; the second discharge passage discharges from the output terminal of the control circuit according to the second control signal.

11. The display panel of claim 10, wherein the second discharge passage comprises a third FET and a second resistor, and wherein a second terminal of the timing controller is connected to a gate of the third FET, a drain of the third FET is grounded, a source of the third FET is connected to a first terminal of the second resistor, and a second terminal of the second resistor is connected to the output terminal of the control circuit.

12. The display panel of claim 11, wherein the second control signal is transmitted to the gate of the third FET, and wherein in response to the first effective voltage level of the second control signal, the third FET is conducted so that the output terminal of the control circuit discharges through the second resistor, and in response to the second effective voltage level of the second control signal, the third FET is turned off so that the output terminal of the control circuit does not discharge.

13. The display panel of claim 8, wherein the duration of the first effective voltage level of the first control signal, the duration of the second effective voltage level of the first control signal, the duration of the first effective voltage level of the second control signal, and the duration of the second effective voltage level of the second control signal are ensured according to the real display effect of the display panel.

14. The display panel of claim 8, wherein the first FET and second FET are P-channel metal-oxide-semiconductor field effect transistors, and the third FET is an N-channel metal-oxide-semiconductor field effect transistor.

* * * * *